US006038750A

United States Patent [19]

Pabst

[11] Patent Number: 6,038,750

[45] Date of Patent: Mar. 21, 2000

[54] STENTER FOR A TEXTILE MATERIAL WEB

[75] Inventor: Manfred Pabst, Cologne, Germany

[73] Assignee: A. Monforts Textilmaschinen GmbH & Co., Mönchengladbach, Germany

[21] Appl. No.: 09/142,725

[22] PCT Filed: Feb. 25, 1997

[86] PCT No.: PCT/DE97/00373

§ 371 Date: Sep. 14, 1998

§ 102(e) Date: Sep. 14, 1998

[87] PCT Pub. No.: WO97/34038

PCT Pub. Date: Sep. 18, 1997

[30] Foreign Application Priority Data

Mar. 14, 1996 [DE] Germany ..... 196 09 928

[51] Int. Cl.[7] ..... D06C 3/02

[52] U.S. Cl. ..... 26/76; 26/91

[58] Field of Search ..... 26/75, 76, 91, 26/93, 96, 74, 51.4, 89; 226/15, 18, 19, 20, 74

[56] References Cited

U.S. PATENT DOCUMENTS

| | | | |
|---|---|---|---|
| 2,088,984 | 8/1937 | Tandel | 26/76 |
| 2,557,492 | 6/1951 | Young | 26/76 |
| 3,482,750 | 12/1969 | Mohring et al. | 26/76 |
| 3,935,979 | 2/1976 | Hickey | 26/76 |
| 3,936,915 | 2/1976 | Becker | 26/76 |
| 3,943,612 | 3/1976 | Campbell | 26/76 |
| 5,014,402 | 5/1991 | Cunningham | 26/91 |
| 5,867,878 | 2/1999 | Foster et al. | 26/76 |

FOREIGN PATENT DOCUMENTS

| | | |
|---|---|---|
| 1 807 389 | 5/1970 | Germany . |
| 22 37 014 | 2/1974 | Germany . |
| 33 05 893 | 8/1984 | Germany . |
| 34 17 030 | 11/1985 | Germany . |
| 2 062 040 | 5/1981 | United Kingdom . |

*Primary Examiner*—Amy Vanatta
*Attorney, Agent, or Firm*—Collard & Roe, P.C.

[57] ABSTRACT

The invention relates to a stenter for a textile material web with two chain conveyors mounted to be pivotable in a scissor-like manner in the feeding section of the machine. The chains extend in the chain conveyors and have gripping means for grasping the material web edges. The free wings or webs of the pivotable chain conveyors are mounted to be movable on a horizontal support by carrier wheels. At least one carrier wheel is in the form of a driven friction wheel, and a drive motor is directly associated with the carrier wheel.

9 Claims, 1 Drawing Sheet

STENTER FOR A TEXTILE MATERIAL WEB

DESCRIPTION

Figure 1:
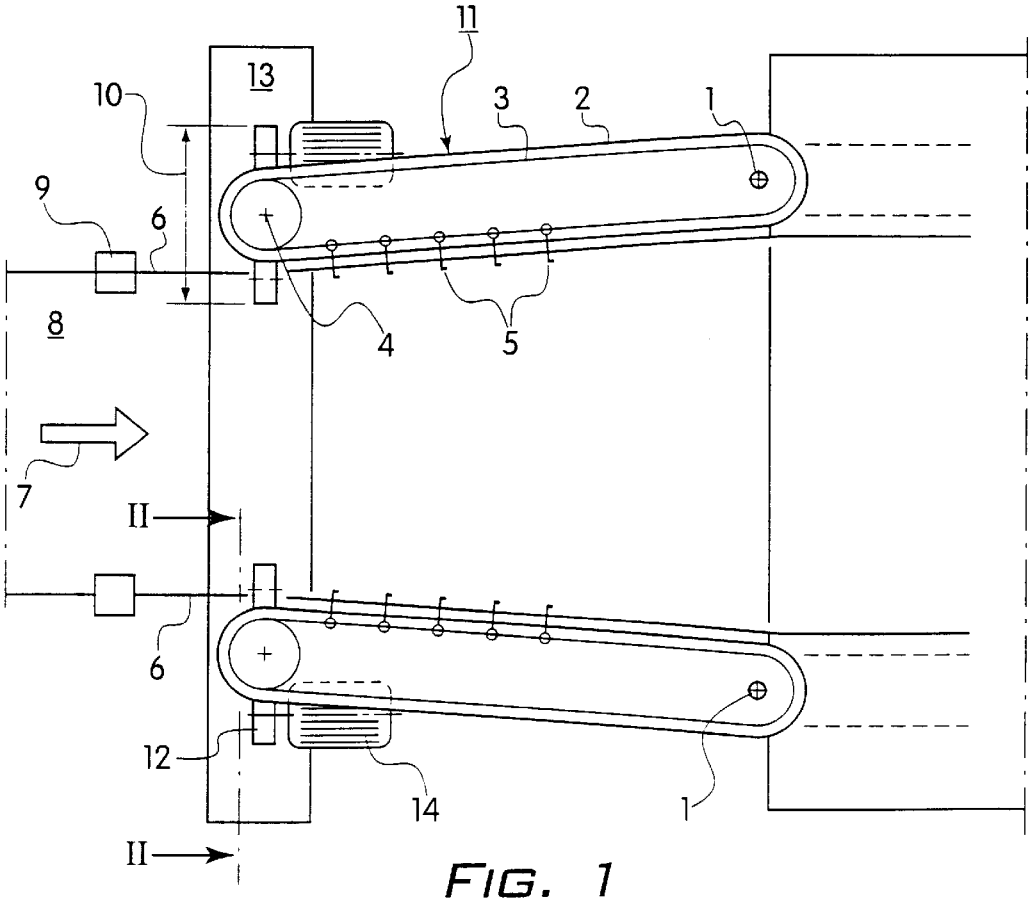

The invention relates to a stenter for a textile material web with two chain conveyors pivotably mounted at the end of the feeding section of the machine, said chain conveyors being pivotable against each other around vertical axles in a scissors-like manner for endless chains reversed in the material web inlet and in the material web outlet, such chains having gripping means for seizing the edges of the material web, whereby provision is made for controlling and driving means for adapting the given spacing of the pivotable ends or wings of the chain conveyors facing away from the axles at the inlet of the feeding section to the measured width of the material web being fed; and whereby the pivotable ends of the chain conveyors are movably supported on a horizontal support by means of carrier wheels.

The feeding section of a stenter of said type, which in practical life is also referred to as a stenter frame, is described in DE 34 17 030 C2. The drawing of DE 22 37 014 B2 clearly shows how a pivotable end of a chain conveyor has to be movably supported on a horizontal support with the help of a carrier wheel.

Provision is made for setting devices, so that the chain guide rails can be adapted to the given width of the textile material web and in order to be able to shift said chain guide rails to the left or right depending on which irregular course the edge of the material web is following. In many cases, such setting devices have to absorb higher forces if the web has to be pulled between the pivotable ends—which can be described also as wings—of the chain conveyor to assume a preset outlet width, starting from the actual inlet width. Furthermore, the mutual spacing of the wings has to be adapted to the width of the instantaneously incoming part of the material web with as little play as possible. Costly toothed-rack drives or chain drives are employed for said reason for setting the wings (DE-AS 18 07 389).

The transverse forces which the wing drives have to control, which in each case is the tension of the web transversely to the direction of transport, are dependent upon which type of material web has to be treated. Material webs with only minor transverse stability, for example knitwear-type materials, are guided through the stenter frame or stentering field with low transverse forces. Higher forces are required if the material has to be pulled to expand it from an actual inlet width to a preset outlet width.

Some companies in the textile industry continually process material webs with very low transverse stability on stenter frames, for example knitwear-type or elastic woven materials. Material webs of this type may be or have to be guided through the stenter frame with low transverse force. Low transverse forces often barely suffice for spreading the respective web in one plane. On the other hand, the known drives designed for relatively high transverse tension, for example according to the above-cited document DE-AS 18 07 389, may actually be replaced by less powerful drives if only lower transverse forces need to be raised. In practical life, however, identical drives are employed in most cases for the transverse setting of the wings irrespective of which transverse forces have to be applied to the material web to be processed in the operation. Simplified stockkeeping and striving for series production may play a role in this connection. However, of decisive importance is the fact that even if the wings have to transmit only low tranverse forces, they have to be exactly and without play adaptable to the given width of the instantaneously incoming material web, or to the course taken by the edges of the material web.

The invention is based on the problem of creating a transverse guiding system for the pivotable ends or wings of the chain conveyors that permits the single-needle or clamping means (gripping means for seizing the edges of the material web) to exactly and practically without delay follow the more or less random course of the edge of the incoming material web without requiring the complicated and costly transverse drives for the wings of known stenter frames.

For the stenter specified above, in which the pivotable ends or wings of the chain conveyors are movably supported on a horizontal support by means of carrier wheels, the solution as defined by the invention consists in that at least one carrier wheel is designed in the form of a driven friction wheel, and in that a drive motor is directly associated with said carrier wheel. At least the driven carrier wheel is preferably tired with solid rubber or another material of this type having a high coefficient of friction specifically with respect to the support. If two carrier wheels are used per chain conveyor or chain wing, it is sufficient according to a further feature of the invention if a motor is connected on the axle of one of the carrier or friction wheels.

Therefore, the problem is already solved in that the carrier wheels are designed in the form of friction wheels preferably tired with full rubber, and in that a driving motor is directly associated with one of the friction wheels, preferably on the axle of the friction wheel. It is surprisingly possible by this measure alone to move the wing—or the single-needle or seizing means of the chain running in the chain conveyor, said means being connected with the wing—always without delay into the place where the edge of the incoming—and particularly light—material web to be seized arrives instantaneously. Admittedly, no high transverse forces can be applied to the material web with such a friction wheel drive, i.e., the material web cannot be stretched wide to any noticeable degree with the help of wings supported and driven in such a way. However, with the help of a setting device used as a wing guide as defined by the invention, an easily stretchable material web can be excellently adjusted to the course of the edge of the material web and the lightweight material can be drawn smooth in the required manner for admitting it into the stenter frame.

Details of the invention are explained with the help of the schematic representation of an exemplified embodiment. In the drawing, FIG. 1 is a top view of the feeding section of a stenter frame; and FIG. 2 is a section along line II—II in FIG. 1.

Figure 2:
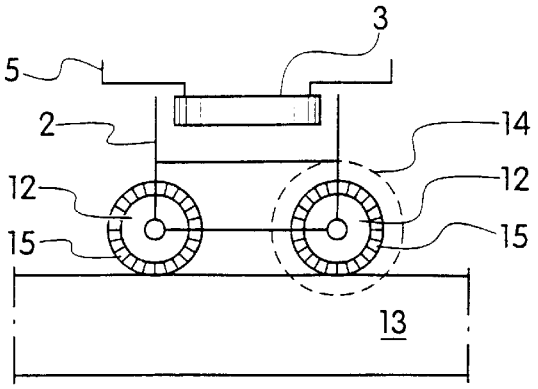

FIG. 1 shows a top view of the feeding section of a stenter, showing the chain conveyors 2 for the endless chains 3. The chain conveyors are pivotably supported for swinging around vertical axles 1 and against each other in a scissors-like manner, and are reversed in the feeding section of the material web inlet around sprocket wheels 4. Chains 3 have seizing means 5, for example needles or pliers for seizing the edges 6 of material web 8 running in in transporting direction 7. The instantaneous position of material web edge 6 is substantially measured continuously with a width sensor 9. Width sensor 9 transmits the measured values to a control unit for controlling driving means, by which the individual chain conveyor 2 can be pivoted back and forth around its axle 1 in swiveling direction 10. The mutual spacing between the ends or wings 11 of the chain conveyors is adjustable by such swiveling. At the same time, the position of the gripping means can be exactly and without delay adapted to the instantaneous position of edge 6 of the incoming material web 8. Wings 11 are movably supported on a horizontal support 13 by means of carrier wheels 12.

According to the invention, at least one of the carrier wheels 12 is designed in the form of a driven friction wheel and a drive motor 14 is directly associated with said carrier wheel 12 in terms of space. Carrier wheels 12 are preferably wheels tired with solid rubber 15. Provision is generally made for two carrier wheels 12 per wing 11, the wheels preferably both being designed in the form of friction wheels tired with solid rubber. The friction wheel to be employed as defined by the invention is preferably structured from a metallic core (e.g. rim) with an elastomer vulcanized to said core for converting the torque of the connected drive motor into a frictional force between the friction wheel and the support.

Within the framework of the invention, a motor 14 is preferably mounted on the axle of one of the carrier wheels 12 of each chain conveyor 11. The following types of motor are preferably employed: spur wheel drive, bevel spur gear drive, worm drive, and spur wheel worm drive motors, each for polyphase or direct-current operation.

Motor 14 is controlled via regulating and controlling means depending on the measurements supplied by associated width sensor 9. Such means are not shown but are readily accessible to the expert in the field. Light scanners with point-like scanning of the edge of the material, but also mechanical scanners with electric contacts are employed for detecting the edge of the material. Light scanners with analog range are preferably used for rapidly moving materials and uneven edges so that the wings can be controlled to follow the edge of the material at high speed. In the simplest case, contactor controls or contactless switching thyristors can be employed as means for controlling the motors. Frequency converters for 4-quadrant operation together with polyphase motors are preferably employed for high-speed applications.

Described is a stenter for a textile material web with two chain conveyors pivotably supported in a scissors-like manner in the deefing section of the machine, with chains with gripping means for seizing the edges of the material web running in said conveyors. The free ends or wings of the pivotable ends of the chain conveyors are movably supported on a horizontal support by means of carrier wheels. According to the invention, at least one carrier wheel is designed in the form of a driven friction wheel, and a driving motor is directly associated with said carrier wheel.

LIST OF REFERENCE NUMERALS

1=Vertical axle
2=Chain conveyor
3=Chain
4=Sprocket wheel
5=Gripping means
6=Edge of material web
7=Transport direction
8=Material web
9=Width sensor
10=Direction of swivel
11=Wing
12=Carrier wheel
13=Support
14=Motor
15=Solid rubber

I claim:

1. A stenter for a textile material web having a plurality of edges and a width, said stenter comprising:

(a) a feeding section having an end, a material web inlet, and a material web outlet;

(b) a horizontal support;

(c) a driving motor;

(d) a plurality of carrier wheels disposed on the support, at least one of said carrier wheels comprising a driven friction wheel driven by said driving motor;

(e) a plurality of endless chains having gripping means for seizing the edges of the material web, said chains being reversed in the material web inlet and in the material web outlet;

(f) two pivotably mounted chain conveyors for the endless chains, said conveyors pivotable against each other around vertical axles in a scissors-like manner at the end of the feeding section, one of said axles being located at the inlet of the feeding section, said conveyors having a plurality of pivotable wings mounted on the carrier wheels to be movable on the horizontal support and facing away from the axle at the inlet of the feeding section, said wings having a given spacing between each other;

(g) a width sensor for measuring the width of the material web being fed; and (h) controlling and regulating means for adapting the given spacing of the pivotable wings of the chain conveyors facing away from the axle at the inlet of the feeding section to the measured width of the material web being fed.

2. The stenter according to claim 1, wherein at least the driven carrier wheel comprises a metallic core with an elastomer coating vulcanized to said core.

3. The stenter according to claim 1, wherein at least the driven carrier wheel comprises tires made of a material having a high coefficient of friction with respect to the support.

4. The stenter according to claim 1, wherein two carrier wheels are provided per chain conveyor.

5. The stenter according to claim 1, wherein each chain conveyor has at least one carrier wheel, each carrier wheel has an axle and a motor is connected on the axle of one of the carrier wheels per chain conveyor.

6. The stenter according to claim 1, wherein the drive motor is selected from the group consisting of a spur gear drive motor, a bevel gear drive motor, a worm gear drive motor or a spur gear worm drive motor, said drive motor being for polyphase or direct-current operation.

7. The stenter according to claim 1, wherein the width sensor comprises light scanners with point-like scanning of one of the edges of the material web.

8. The stenter according to claim 1, further comprising a means for controlling the driving motor selected from the group consisting of a contractor control and a contactless switching thyristor.

9. The stenter according to claim 1, wherein the driving motor is a polyphase motor and further comprising a means for controlling the driving motor comprising a plurality of frequency converters for 4-quadrant operation.

* * * * *